United States Patent [19]

Müller

[11] Patent Number: 4,921,148

[45] Date of Patent: May 1, 1990

[54] ADJUSTABLE HOUSING ASSEMBLY FOR SLIDING CLOSURE UNIT

[75] Inventor: Hans Müller, Steinhausen, Switzerland

[73] Assignee: Stopinc Aktiengesellschaft, Baar, Switzerland

[21] Appl. No.: 813,552

[22] Filed: Dec. 26, 1985

[30] Foreign Application Priority Data

Jan. 12, 1985 [DE] Fed. Rep. of Germany ..... 3500865

[51] Int. Cl.[5] ..... B22D 41/08

[52] U.S. Cl. ..... 222/597; 222/600

[58] Field of Search ..... 222/598, 599, 600, 536; 49/193; 251/326; 16/229, 230, 231; 105/281

[56] References Cited

U.S. PATENT DOCUMENTS

| | | | |
|---|---|---|---|
| 3,511,471 | 5/1970 | Rossi | 222/598 |
| 3,654,663 | 4/1972 | Algotsson | 16/230 |
| 3,721,363 | 3/1973 | Bressler et al. | 16/230 X |
| 4,056,217 | 11/1977 | Aliprandi et al. | 222/600 |
| 4,294,437 | 10/1981 | Sawada et al. | 222/600 |
| 4,508,341 | 4/1985 | Bauer et al. | 222/600 |
| 4,543,981 | 10/1985 | Bates et al. | 222/599 X |
| 4,557,785 | 3/1986 | Wakabayashi | 222/598 |

FOREIGN PATENT DOCUMENTS

| | | | |
|---|---|---|---|
| 475136 | 10/1973 | Australia | 222/600 |
| 247498 | 6/1966 | Austria | 49/193 |
| 2941027 | 4/1980 | Fed. Rep. of Germany . | |

*Primary Examiner*—Joseph J. Rolla
*Assistant Examiner*—Gregory L. Huson
*Attorney, Agent, or Firm*—Wenderoth, Lind & Ponack

[57] ABSTRACT

A housing assembly of a sliding closure unit for controlling the discharge of molten metal from a metallurgical vessel includes a housing member mounted on the metallurgical vessel adjacent an outlet thereof, and a cover member mounted on the housing member by joints to enable the cover member to pivot with respect to the housing member and to be removable therefrom. The joints include joint bases on at least four sides of each of the housing and cover members and including, for each of the housing and cover members, first and second oppositely spaced sides with the joint bases thereof defining parallel first and second joint axes, respectively, and third and fourth oppositely spaced sides with the joint bases thereof defining parallel third and fourth axes, respectively. The joint bases on each side of the cover member face joint bases of a respective side of the housing member. The joints include attachment structure for selective attachment to the joint bases of the first and second sides of the housing and cover members or to the third and fourth sides of the housing and cover members, thereby to pivotally and removably connect the cover member to the housing member.

16 Claims, 2 Drawing Sheets

ADJUSTABLE HOUSING ASSEMBLY FOR SLIDING CLOSURE UNIT

BACKGROUND OF THE INVENTION

The present invention relates to an adjustable housing assembly for use on a slide gate or sliding closure unit for controlling the discharge of molten metal from a metallurgical vessel. More particularly the present invention relates to such an adjustable housing assembly of the type including a housing member to be mounted on the metallurgical vessel adjacent a molten metal outlet thereof, and a cover member mounted on the housing member by means of joints to enable the cover member to pivot with respect to the housing member and to be removable therefrom.

Sliding closure units normally are mounted on the bottoms of metallurgical vessels. Depending upon the local conditions of a particular installation, such as for example the extent and location of adjusting legs and ribs on the bottom of the vessel adjacent the particular location of the molten metal discharge therefrom and the relative position of the metallurgical vessel in the overall installation, the mounting of the sliding closure units causes considerable problems. Thus, it is difficult to find a favorable and optimal mounting location for the sliding closure unit and its drive unit, since often there is not sufficient space available for the necessary pivoting of a cover member of the housing assembly of the sliding closure unit to enable rapid and thorough maintenance thereof. Often, it is necessary to incorporate design changes in the overall installation to allow for necessary space to achieve such functions. West German Patent DE-PS 29 41 027 discloses a rotary sliding closure unit including a housing assembly having a cover member pivoted upwardly selectively from two opposite sides of a housing member by releasing one of two opposed pairs of hinge pins. However, the above described difficulties are not entirely solved by this apparatus.

SUMMARY OF THE INVENTION

With the above discussion in mind, it is an object of the present invention to provide an improved housing assembly for use in sliding closure units of the rectilinear, rotary or swivel movement type for controlling the discharge of molten metal from a metallurgical vessel, whereby it is possible to overcome the above the other prior art disadvantages.

It is a further object of the present invention to provide such a housing assembly including a cover member adjustably and selectively mounted in a manner adapted to enable removal or open pivoting movement thereof in a desired number of selected directions.

It is a yet further object of the present invention to provide such a housing assembly requiring less space than known assemblies but offering greater flexibility of operation.

It is a still further object of the present invention to provide such a housing assembly which is of simple and inexpensive structure.

The above and other objects of the present invention are achieved by the provision of a housing assembly including a housing member to be mounted on a metallurgical vessel adjacent an outlet thereof, and a cover member mounted on the housing member by means of joints to enable the cover member to pivot with respect to the housing member and to be removable therefrom.

In accordance with the present invention, the joints include joint bases on at least four sides of each of the housing and cover members including, for each of the housing and cover members, first and second oppositely spaced sides with the joint bases thereof defining parallel first and second joint axes, respectively, and third and fourth oppositely spaced sides with the joint bases thereof defining parallel third and fourth axes, respectively. The joint bases of the respective side of the housing member face joint bases of the respective side of the housing member. There is provided means for selective attachment to the joint bases of the first and second sides of the housing and cover members or to the third and fourth sides of the housing and cover members to thereby pivotally and removable connect the cover member to the housing member. Thus, in accordance with the present invention, the cover member is selectively mountable along more than one side of the housing member, such that the cover member may be pivoted in different directions to be accommodated to space requirements at a particular installation. Specifically, it is possible to pivot the cover member in a horizontal or lateral direction, as is optimum for the surrounding conditions at a given installation location.

The joint bases on at least the first, second and third sides of each of the housing and cover members are identical, and preferably such joint bases comprise respective pairs of projections. The attachment means is in the form of strap members selectively hinged to the joint bases of the first sides of the housing and cover members or to the joint bases of the second sides of the housing and cover members. As a result, the cover member may be mounted in a manner to be selectively pivotable with respect to the housing member about the first axes or the second axes. In such arrangement, the attaching means further includes locking levers selectively connectable to the joint bases of the second sides of the housing and cover members or to the joint bases of the first sides of the housing and cover members, such that a cover member is locked or released with respect to the housing member along the second sides or along the first sides thereof.

In accordance with one embodiment of the present invention, when the joints are arranged along the third and fourth sides, rather than along the first and second sides, the attachment means includes strap members selectively hinged to the joint bases of the third sides of the housing and cover members, such that the cover member is pivotable with respect to the housing member about the third axes, and a latch member is positioned substantially within the housing and cover members and cooperates with the joint bases of the fourth sides thereof, thereby to lock or release the cover member with respect to the housing member along the fourth sides.

As an alternative arrangement, the joint bases on the fourth sides of each of the housing and cover members comprise respective pairs of projections identical to the projections on the third sides thereof. Thus, the strap members, rather than being selectively hinged on the joint bases of the first or second sides of the housing and cover members, in this arrangement also or alternatively may be hinged to the joint bases of the third sides or the fourth sides of the cover and housing members. As a result, the cover member is selectively pivotable with respect to the housing member about the third axes or about the fourth axes. In such arrangement, the locking levers selectively are connectable to the joint bases of the fourth sides of the housing and cover members or to the joint bases of the third sides of the housing and cover members. Thereby, the cover member is locked or released with respect to the housing member along the fourth sides or the third sides thereof.

By the above alternative arrangements and embodiments of the present invention, it is possible to mount a particular cover member to pivot with respect to the housing member in a variety of different directions, at least four directions. Thus, it is possible to accommodate the sliding closure unit, and specifically the housing assembly thereof, to the particular space available at a given installation, without the need for design modifications of the installation itself.

In accordance with another aspect of the present invention, there is provided means for attaching the housing member to the metallurgical vessel such that the housing member is symmetrical with respect to the molten metal outlet of the vessel, and for enabling selective adjustment of the position of the housing member with respect to the metallurgical vessel about the axis of the molten outlet. Specifically, there is provided a centering ring to be fixed to the metallurgical vessel coaxially of the molten metal outlet axis, and the housing member is mounted on the centering ring at a plurality of relative positions with respect thereto about the outlet axis. Thus, the housing member is connected to the centering ring by means of at least three bolts which are threaded into the centering ring at respective positions equally circumferentially spaced about the outlet axis. When three such bolts are provided, then they are threaded into the centering ring at positions spaced circumferentially by 120° with respect to each other. The number of bolts however may be increased as desired, thereby increasing the number of relative positions of the housing assembly with respect to the metallurgical vessel, and thereby increasing the*4 number of directions at which the cover member may be pivoted. When the sliding closure unit is of the rectilinearly movable type, normally with a rectangular configuration, then preferably there are provided four attachment bolts spaced circumferentially from each other by 90°.

BRIEF DESCRIPTION OF THE DRAWINGS

Other objects, features and advantages of the present invention will be apparent from the following detailed description of various embodiments thereof, with reference to the accompanying drawings, wherein.

DETAILED DESCRIPTION OF THE INVENTION

Figure 1:
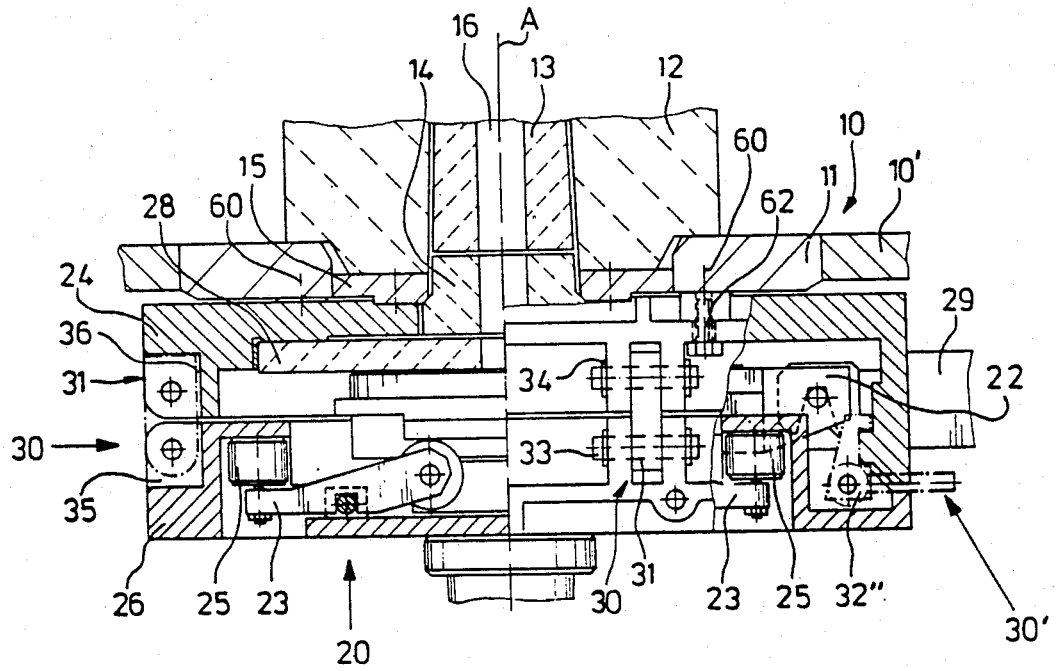
FIG. 1 is a view, partially in longitudinal section and partially in elevation, of a sliding closure unit mounted adjacent the bottom outlet of a metallurgical vessel and incorporating a housing assembly according to the present invention.

In FIG. 1 there is shown schematically a bottom portion of a metallurgical vessel 10 including an outer metal jacket 10' interiorly of which is a refractory lining, not shown, through which extends a perforated nozzle brick 12 having therein a two-part refractory inlet sleeve or nozzle 13, 14 having therethrough a molten metal outlet orifice or opening 16. Within jacket 10' is welded a ring 11 supporting brick 12, and within ring 11 is positioned a centering ring 15 to center brick 12 and inlet sleeve or nozzle 13, 14.

Figure 2:
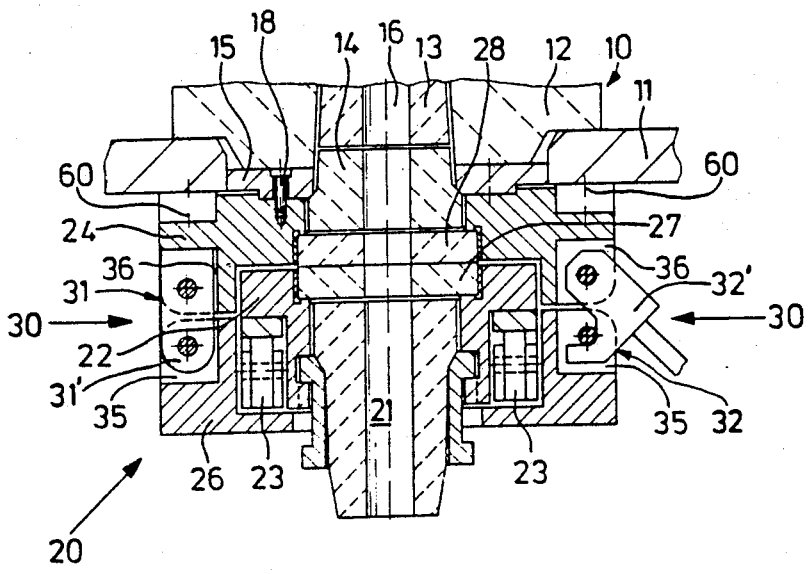
FIG. 2 is a transverse cross-sectional view of the arrangement of FIG. 1.

A sliding closure unit 20 includes a stationary housing assembly including a housing member 24 connected to ring 11 by attaching means 60, for example in the form of bolts 62, and also connecting to centering ring 15, for example by means of bolts 18 as shown in FIG. 2. Within housing member 24 is supported a stationary refractory plate 28. A cover member 26 is mounted on housing member 24 by means of joints to enable the cover member to be pivotable with respect to the housing member and to be removable therefrom. Within cover member 26 is a movable frame 22 which supports a movable refractory plate 27 and which is movable in a rectilinear direction by means of a drive unit, only a rod 29 of which is shown in FIG. 1. Plates 28 and 27 have complementary, abutting relative sliding surfaces, and frame 22 and plate 27 are pressed toward plate 28 in a sealing manner by means of springs assemblies in the form of spring 25 acting on pivotable levers 23. The structure and manner of operation of such spring assemblies does not itself constitute a portion of the present invention, ut rather is the invention of a U.S. patent application entitled "APPARATUS FOR RELIEVING THE PRESSURE OF CLAMPING SPRINGS IN A SLIDING CLOSURE UNIT" filed on even date herewith by Hans Müller and Otto Kägi and assigned to the assignee of the present application. The disclosure of such application hereby is incorporated by reference.

When it becomes necessary to inspect or repair the internal components of the sliding closure unit 20, then cover member 26 must be pivoted with respect to housing member 24, or removed therefrom. In accordance with the present invention, the cover member 26 is connected to housing member 24 in a manner to readily facilitate such opening pivotal movement or removal, and specifically to enable such operations to be achieved in a wide variety of directions, thereby to be accommodated to the particular available space adjacent the metallurgical vessel of a given installation.

Figure 3:
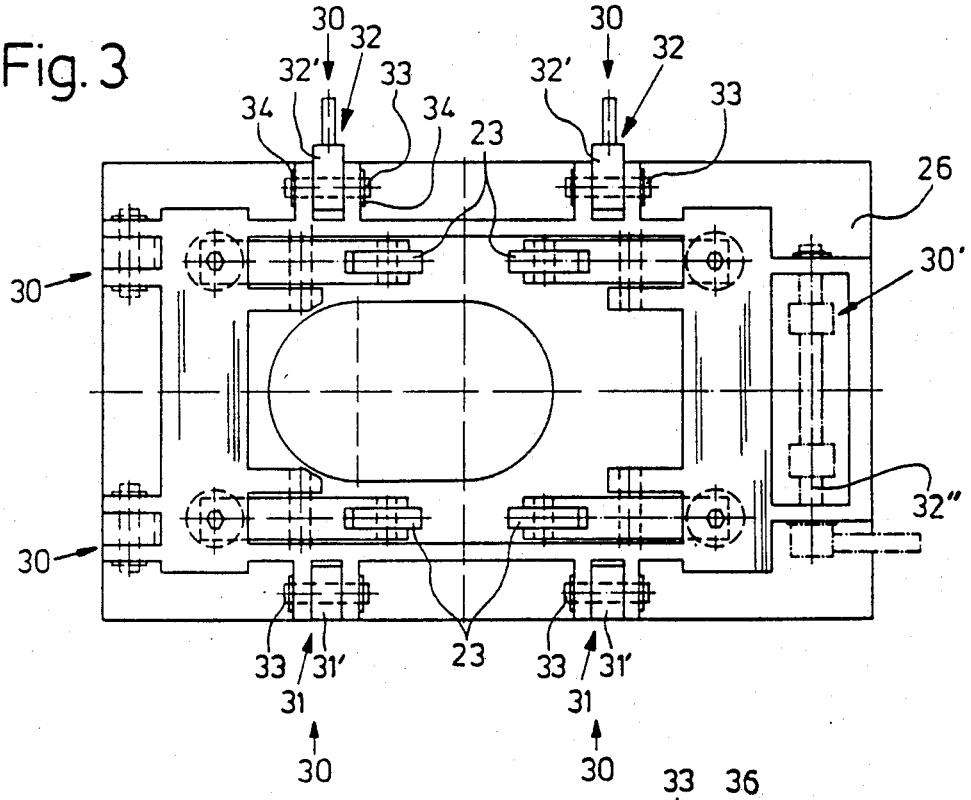
FIG. 3 is a top plan view of the cover member of FIG. 1 shown removed from the housing member but illustrating the novel joint constructions according to one embodiment of the present invention.

Thus, in accordance with the present invention there are provided joint bases on at least four sides of each of the housing member 24 and cover member 26, including, for each of the housing and cover members, first and second oppositely spaced sides, i.e. upper and lower sides as shown in FIG. 3, and third and fourth oppositely spaced sides as shown in FIG. 3. The first and second sides have joint bases defining parallel first and second joint axes, and the third and fourth oppositely spaced sides have joint bases defining parallel third and fourth axes.

Thus, in the specific arrangement shown in FIGS. 1–3, the housing and cover members are generally of rectangular configuration having two long sides, i.e. the upper and lower sides in FIG. 3, and two short sides, i.e. the left and right sides in FIG. 3. The first through third sides, i.e. the upper, lower and left sides in FIG. 3, of each of the housing and cover members having extending therefrom joint bases in the form of projections 36, 35, respectively. The cover member may be pivotally mounted to the housing member to pivot about either of the long sides thereof, and in the arrangement shown in FIGS. 1–3 the cover member 26 is pivoted about the second side, i.e. the lower long side shown in FIG. 3 and the left side of FIG. 2. This is achieved by strap members 31' pivotally connected to respective projections 36, 35 means of axles 33 retained in position by locking rings 34, thereby defining hinge joints 31 at respective joint positions 30. the opposite long side of the housing member has pivotally connected thereto about respective axles 33 locking levers 32' having hook portions engageable with respective axles 33 extending through and retained in projections 35 of the cover member 26. The locking levers 32' thereby cooperate to releasably secure the cover member 26 to the housing member 24 at respective locking joints 32 at joint positions 30 along the respective long sides. Counterclockwise pivoting of locking levers 32' from the position shown in FIG. 2 will enable the cover member 26 to pivot with respect to the housing member 24 about the respective axes defined by axles 33 supporting strap members 31' in projections 36, 35 along the left side of FIG. 2.

In the embodiment illustrated in FIGS. 1–3, the cover member 26 may alternatively be connected to the housing member 24 along the short sides thereof, rather than the long sides thereof. This is shown by dashed lines in FIGS. 1 and 3, wherein the third sides, i.e. the left sides in FIGS. 1 and 3, of the housing and cover members include joint bases in the form of projections 36, 35 identical to those of the long sides. Strap members may be connected in a pivotable manner between the projections 36, 35 of the short side in the same manner as discussed above. The opposite short sides of the housing member and cover member however are locked by a mechanism which is different from that discussed above regarding the long sides. Thus, a lock joint 30' is defined by a latch member 32'' pivotally mounted in joint bases formed along the respective side of cover member 26 and includes hook-shaped projections positionable over and latchable on corresponding projections formed inwardly of housing member 24. This latching arrangement has the advantage that the locking joint substantially is housed within the housing assembly.

Figure 4:
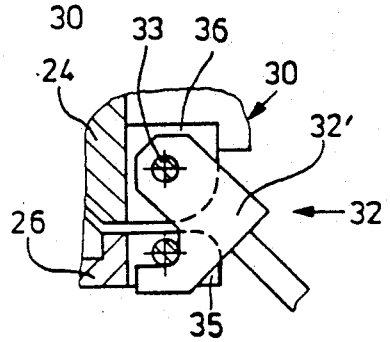
FIG. 4 is an enlarged partial view of the lower right-hand portion of FIG. 1, but illustrating a modification of the joint configuration thereof.

The lock joint 30' however can be replaced, as shown in FIG. 4, by a pair of locking joints 32 in the same manner as the locking joints 32 shown along the first side, i.e. the upper side of FIG. 3. In this modification, it is possible to pivotally mount the cover member 26 to the housing member 24 along any of the four respective sides thereof.

Figure 5:
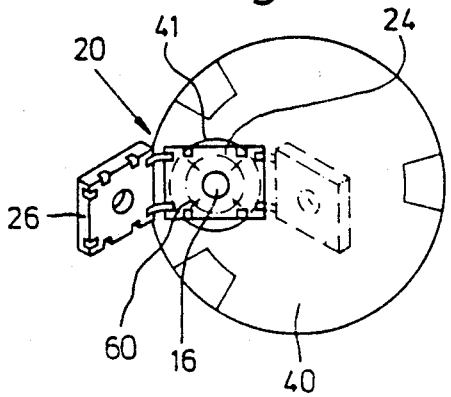
FIGS. 5 and 6 are schematic views illustrating various manners of adjustment provided by the housing assembly of the present invention.
Figure 6:
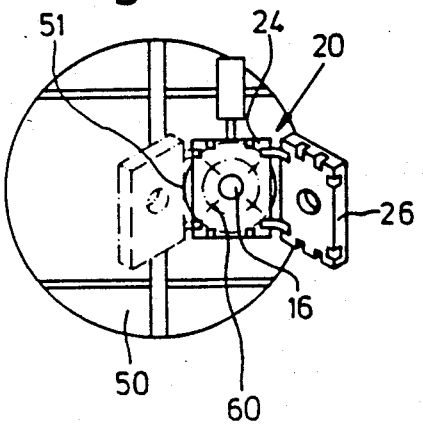

FIG. 5 and 6 illustrate different possible arrangements of mounting of the cover member 26 on the housing member 24 with respect to metallurgical vessels 40, 50. Specifically, FIG. 5 shows that the cover member may be mounted for lateral pivoting movement along either of the short sides, whereas FIG. 6 shows that the cover member may be mounted for lateral pivotal movement about either of the long sides. In both arrangements, the cover member 26 could be mounted for pivotal movement along the upper or lower sides.

FIGS. 5 and 6 illustrate an additional feature of the present invention. Thus, connections 60 of the housing member 24 to the metallurgical vessel are shown as being at four equally circumferentially spaced position, i.e. at 90° intervals. Accordingly, the housing member itself may be rotated from the respective positions shown in FIGS. 5 and 6. Connections 60 are shown as being located symmetrically around the axis of outlet 16. Rings 41 and 51 of FIGS. 5 and 6, respectively correspond to ring 11 of FIG. 1.

The above embodiments have been described with respect to a sliding closure unit of the rectilinear movable type. It is to be understood however, as would be apparent to those skilled in the art, that the adjustable housing assembly of the present invention can be employed equally with sliding closure units of the rotary or swivelly movable type.

Although the present invention has been described and illustrated with respect to preferred features thereof, it is to be understood that various modifications and changes may be made to the specifically described and illustrated features without departing from the scope of the present invention.

I claim:

1. In a housing assembly of a sliding closure unit for controlling the discharge of molten metal from a metallurgical vessel, said housing assembly including a housing member to be mounted on the metallurgical vessel adjacent an outlet thereof, and a cover member mounted on said housing member by means of joints to enable said cover member to pivot with respect to said housing member and to be removable therefrom, the improvement wherein said joints comprise:

joint bases on at least four sides of each of said housing and cover members including, for each of said housing and cover members, first and second oppositely spaced sides with said joint bases thereof defining parallel first and second joint axes, respectively, and third and fourth oppositely spaced sides with said joint bases thereof defining parallel third and fourth axes, respectively;

said joint bases on each side of said cover member facing joint bases of a respective side of said housing member; and means for selective attachment to said joint bases of said first and second sides of said housing and cover members or to said joint bases of said third and fourth sides of said housing and cover members to thereby pivotally and removably connect said cover member to said housing member, said attachment means comprising strap members selectively hinged to said joint bases of said first sides of said housing and cover member or to said joint bases of said second sides of said housing and cover members, such that said cover member is selectively pivotable with respect to said housing member about said first axes or said second axes, and locking levers selectively connectable to said joint bases of said second sides of said housing and cover members or to said joint bases of said first sides of said housing and cover members, to thereby lock or release said cover member with respect to said housing member along said second sides or said first sides.

2. The improvement claimed in claim 1, wherein said first and second axes extend perpendicularly of said third and fourth axes.

3. The improvement claimed in claim 1, wherein said joint bases on said first, second and third sides of each of said housing and cover members are identical.

4. The improvement claimed in claim 3, wherein said joint bases on said first, second and third sides of said housing and cover members comprise respective pairs or projections.

5. The improvement claimed in claim 1, wherein said joint bases on said fourth sides of each of said housing and cover members comprise respective pairs of projections identical to said projections on said third sides thereof.

6. The improvement claimed in claim 5, wherein said strap members are selectively hinged to said joint bases of said third sides of said housing and cover members or to said joint bases of said fourth sides of said housing and cover members, such that said cover member is selectively pivotable with respect to said housing member about said third axes or said fourth axes, and said locking levers are selectively connectable to said joint bases of said fourth sides of said housing and cover members or to said joint bases of said third sides of said housing and cover members, to thereby lock or release said cover member with respect to said housing member along said fourth sides or said third sides.

7. The improvement claimed in claim 1, further comprising means for attaching said housing member to the metallurgical vessel such that said housing member is symmetrical with the outlet thereof, and for enabling selective adjustment of the position of said housing member with respect to the metallurgical vessel about an axis of the outlet.

8. The improvement claimed in claim 7, further comprises a centering ring to be fixed to the metallurgical vessel coaxially of the outlet axis, and means for mounting said housing member on said centering ring at a plurality of relative positions with respect thereto about the outlet axis.

9. The improvement claimed in claim 8, wherein said mounting means comprises at least three bolts threaded into said centering ring and connecting said housing member thereto at respective positions equally circumferentially spaced about the outlet axis.

10. In a housing assembly of a sliding closure unit for controlling the discharge of molten metal from a metallurgical vessel, said housing assembly including a housing member to be mounted on the metallurgical vessel adjacent an outlet thereof, and a cover member mounted on said housing member by means of joints to enable said cover member to pivot with respect to said housing member and to be removable therefrom, the improvement wherein said joints comprise:

joint bases on at least four sides of each of said housing and cover members including, for each of said housing and cover members, first and second oppositely spaced sides with said joint bases thereof defining parallel first and second joint axes, respectively, and third and fourth oppositely spaced sides with said joint bases thereof defining parallel third and fourth axes, respectively;

said joint bases on each side of said cover member facing joint bases of a respective side of said housing member; and means for selective attachment to said joint bases of said first and second sides of said housing and cover members or to said joint bases of said third and fourth sides of said housing and cover members to thereby pivotally and removably connect said cover member to said housing member, said attachment means comprising strap members selectively hinged to said joint bases of said third sides of said housing and cover members, such that said cover member is pivotable with respect to said housing member about said third axes, and a latch member positioned substantially within said housing and cover members and cooperable with said joint bases of said fourth sides thereof, to thereby lock or release said cover member with respect to said housing member along said fourth sides.

11. The improvement claimed in claim 10, wherein said first and second axes extend perpendicularly of said third and fourth axes.

12. The improvement claimed in claim 10, wherein said joint bases on said first, second and third sides of each of said housing and cover members are identical.

13. The improvement claimed in claim 12, wherein said joint bases on said first, second and third sides of said housing and cover members comprise respective pairs of projections.

14. The improvement claimed in claim 10, further comprising means for attaching said housing member to the metallurgical vessel such that said housing member is symmetrical with the outlet thereof, and for enabling selective adjustment of the position of said housing member with respect to the metallurgical vessel about an axis of the outlet.

15. The improvement claimed in claim 14, further comprises a centering ring to be fixed to the metallurgical vessel coaxially of the outlet axis, and means for mounting said housing member on said centering ring at a plurality of relative positions with respect thereto about the outlet axis.

16. The improvement claimed in claim 15, wherein said mounting means comprises at least three bolts threaded into said centering ring and connecting said housing member thereto at respective positions equally circumferentially spaced about the outlet axis.

* * * * *